US005650196A

United States Patent [19]

Mühlfriedel et al.

[11] Patent Number: 5,650,196

[45] Date of Patent: Jul. 22, 1997

[54] DEVICE FOR COATING SUBSTRATES IN SEMICONDUCTOR PRODUCTION

[75] Inventors: Eberhard Mühlfriedel, Maulbronn; Karl Appich, Sternengels; Martin Kallis, Mühlacker, all of Germany

[73] Assignee: Steag MicroTech GmbH, Pliezhausen, Germany

[21] Appl. No.: 268,845

[22] Filed: Jun. 30, 1994

Related U.S. Application Data

[63] Continuation-in-part of Ser. No. 144,789, Oct. 29, 1993, abandoned, and a continuation of Ser. No. 144,787, Oct. 29, 1993, abandoned, which is a continuation-in-part of Ser. No. 66,107, May 28, 1993, abandoned.

[30] Foreign Application Priority Data

| | | | |
|---|---|---|---|
| May 5, 1993 | [WO] | WIPO | PCT/DE93/00392 |
| Aug. 26, 1993 | [WO] | WIPO | PCT/DE93/00777 |
| Aug. 26, 1993 | [WO] | WIPO | PCT/DE93/00778 |

[51] Int. Cl.[6] ..... B05D 3/12

[52] U.S. Cl. ..... 427/240; 118/52; 118/500; 427/385.5; 427/443.2

[58] Field of Search ..... 427/240, 385.5, 427/443.2; 437/231; 118/500, 52

[56] References Cited

U.S. PATENT DOCUMENTS

| | | | |
|---|---|---|---|
| 2,046,596 | 7/1936 | Zwiebel | 118/302 |
| 4,018,953 | 4/1977 | Martellock | 118/405 |
| 4,119,744 | 10/1978 | Brissot et al. | 427/45 |
| 4,851,263 | 7/1989 | Ishii et al. | 427/240 |
| 5,199,990 | 4/1993 | Zeniya | 118/401 |
| 5,270,079 | 12/1993 | Bok | 427/429 |
| 5,275,658 | 1/1994 | Kimura et al. | 118/52 |

FOREIGN PATENT DOCUMENTS

| | | |
|---|---|---|
| 0180078 | 5/1986 | European Pat. Off. . |
| 57-76835 | 5/1982 | Japan . |
| 2098510 | 11/1982 | United Kingdom . |

OTHER PUBLICATIONS

IBM Technical Disclosure Bulletin; vol. 32, No. 1; Jun. 1989 Upside–Down Resist Coating of Semiconductor Wafers.

IBM Technical Disclosure Bulletin; vo. 10, No. 5; Oct. 1967; Ultrasonic Fountain Processor; C. J. Keller.

*Primary Examiner*—Janyce Bell
*Attorney, Agent, or Firm*—Robert W. Becker & Associates

[57] ABSTRACT

A device for coating substrates has a capillary slot which is used in a first step to apply lacquer to the substrate. In a second step, the lacquer layer thickness of the substrate is reduced and made more uniform by spinning in a spinning device.

25 Claims, 6 Drawing Sheets

DEVICE FOR COATING SUBSTRATES IN SEMICONDUCTOR PRODUCTION

This application is a continuation-in-part of application Ser. No. 08/144,789 filed Oct. 29, 1993, now abandoned, which is a continuation of International Patent Application Serial Number PCT/DE93/00778 filed Aug. 26, 1993, and of application Ser. No. 08/144,787 filed Oct. 29, 1993, now abandoned which is a continuation-in-part of application Ser. No. 08/066,107 filed May 28, 1993, now abandoned.

BACKGROUND OF THE INVENTION

The present invention relates to a device and method for lacquering or coating of plates or disks by means of an open channel and, in particular, by means of an open channel that is narrowed to a capillary slot, especially for coating glass plates for LCD production.

The present invention furthermore relates to a device and method for coating of semiconductor substrates in two steps. In the first step the coating medium or lacquer is applied preferably with a capillary slot that is filled with the coating medium or lacquer and across which the substrate, with the surface to be coated facing downwardly, is guided. In the second step, the lacquer layer thickness is made more uniform and thinner in a spinning operation with the surface to be coated facing downwardly.

In the field of thin layer technology and semiconductor manufacture, especially for the production of LCD monitors, masks for semi-conductor manufacture, semi-conductor or ceramic substrates etc., the following problem is often encountered: Rectangular or round plates must be provided with a uniform layer of lacquer or other initially liquid media for color filters or special protective layers. With commonly known devices the plates are horizontally attached to a turntable. To the center point of the plate a certain amount of lacquer or liquid is dripped from above with a nozzle. Then the turntable is rotated. Due to centrifugal forces the liquid is distributed on the substrate during rotation. A large portion of the liquid is spun across the rim of the plate. The uniformness of the layer thickness that is to be achieved with this process depends on the magnitude of the rotation acceleration and speed.

Difficulties with respect to the uniformness of the lacquer thickness on rectangular plates result with the known processes especially in the area of the corners of the plate. In these areas commonly strips of greater or lesser lacquer thickness are observed which are concentric to the center of the substrate. This causes a substantial reduction in the uniformness of the lacquer thickness.

In order to collect the lacquer which is spun across the rim of the substrate, and also for protecting the lacquering station, such lacquering turntables are commonly mounted within some form of a container. It cannot be prevented that lacquer stains are also deposited on the lateral areas of the substrate. This is disadvantageous for the further processing of the substrate. Another disadvantage of the known method is that more than 90% of the lacquer used is spun over the rim of the plate. This excess lacquer cannot be reused and is thus lost. Furthermore, the entire construction and the drive of the turntable are complicated and expensive.

From German Offenlegungsschrift 40 21 621 an improvement of this lacquering and coating process is known. Here, the liquid is sprayed in the form of a flood onto the plate with a porous tube. It may be disadvantageous for the coating process that the liquid is altered in certain properties, for example, solvent content and viscosity, by the spraying process and the corresponding pumping action. Furthermore, it is required that the flow conditions are maintained constant in order to be able to achieve the uniformness of the layer thickness required for various applications.

It is therefore an object of the present invention to improve the known lacquering and coating processes and devices with respect to the aforementioned criteria and to achieve for the process of lacquering of semi-conductor substrates the required high uniformness of the lacquer layer thickness.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
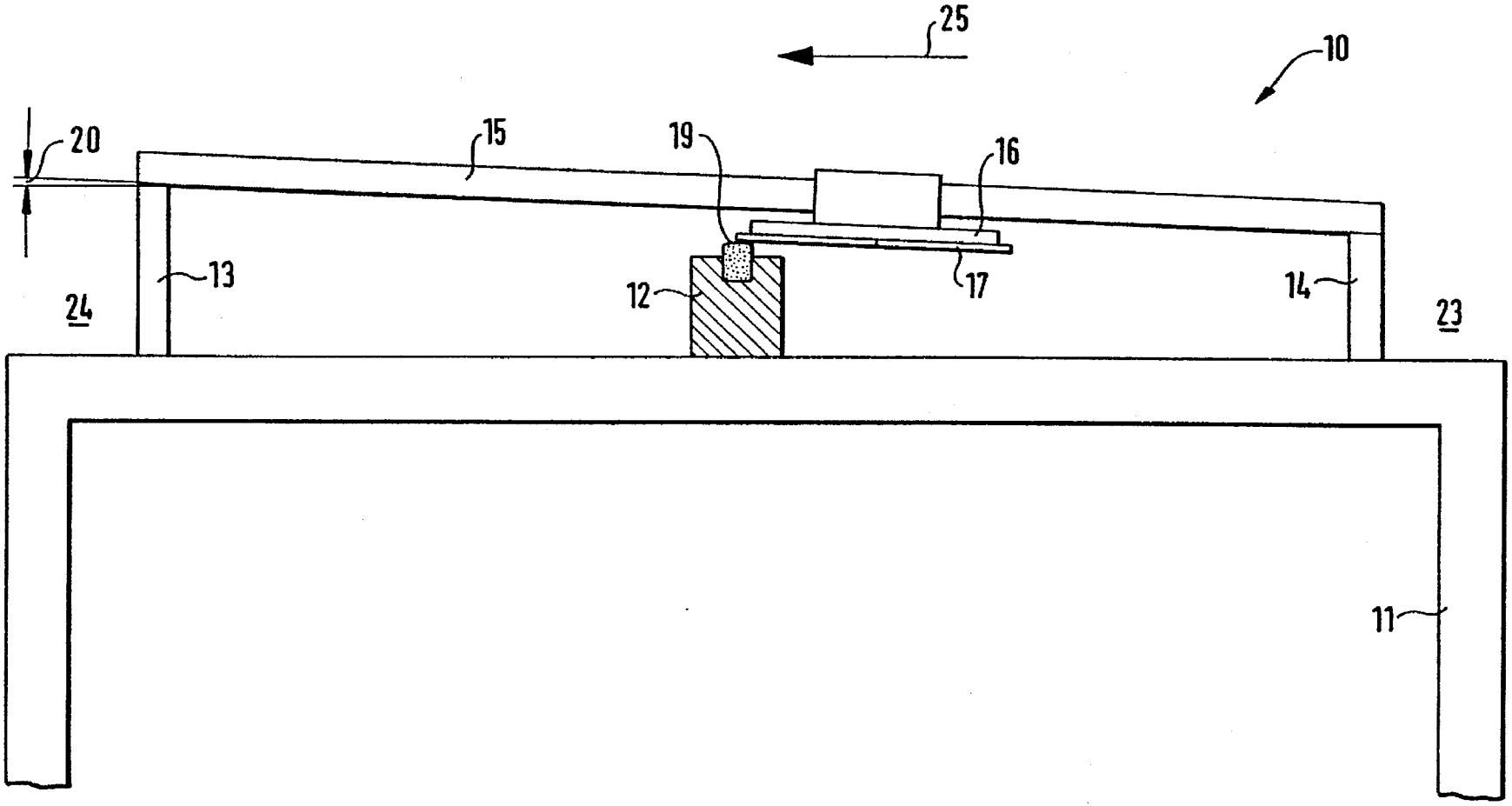
FIG. 1 shows a view of the construction of an inventive lacquering and coating device.

The inventive device for coating substrates in two steps is primarily characterized by:

- an upwardly facing capillary slot for coating a downwardly facing surface to be coated of a substrate with a coating of a coating medium contained in the capillary slot; and
- a means for spinning the substrate so as to make the coating more uniform and thinner in a spinning operation by centrifugal forces acting on the coating.

Preferably, during coating and spinning the surface to be coated is facing downwardly.

Expediently, the coating device further comprises a linear transport device, wherein the means for spinning comprises a spinning station and wherein the capillary slot and the means for spinning are positioned adjacent to one another. The linear transport device is adapted to transport the substrate from the capillary slot to the spinning station.

Advantageously, the means for spinning comprises a holding device for holding the substrate. The holding device comprises a motor and a turntable driven by the motor, the turntable comprising means for releasably attaching the substrate thereto. The holding device is connected to the linear transport device and serves to transport the substrate.

The spinning station comprises a protective ring having in cross-section a U-shaped profile with slanted legs and means for positioning the protective ring around the substrate during spinning in order to catch the coating medium that is being spun off.

The means for positioning is adapted to lower the protective ring into a rest position below the substrate.

The coating device further comprises a loading station for loading the substrate onto the holding device and an unloading station for removing the substrate from the holding device at the spinning station such that the coating device operates fully automatically.

The device preferably further comprises a means for supplying a liquid to the capillary slot. The means for supplying a liquid expediently comprises an open channel partially filled to a filling level with the liquid coating medium. The capillary slot is formed by two parallel plates immersed into the liquid coating medium contained in the open channel. The filling level of the channel is maintained constant with the means for supplying a liquid. The means for supplying a liquid comprises a compensation tank and a supply container, wherein the filling level is maintained constant by hydrostatic pressure from the compensation tank and wherein the compensation tank is refilled by the supply container.

Preferably, a means for adjusting a distance between the parallel plates in an infinitely variable manner is provided. After each coating process the distance between the parallel plates is enlarged to cancel the capillary effect (capillary action) and preserve the liquid coating medium. Immediately before each coating process the distance between said parallel plates is decreased for pressing a small amount of the liquid coating medium out of the capillary slot to thereby start the coating process.

In another embodiment, a holding device for holding the substrate and a means for moving the capillary slot are provided so that the coating process is performed with the holding device being stationary and the capillary slot being moved across the substrate.

The present invention further relates to a method for coating substrates. According to the present invention the method is primarily characterized by the following steps:

coating a downwardly facing surface of a substrate by passing the substrate over an upper end of a capillary slot containing a coating medium to produce a coated substrate with a coating on the downwardly facing surface; and spinning the coated substrate so as to make the coating more uniform by centrifugal forces acting thereon during spinning.

The method preferably further comprises, after coating the substrate, the step of automatically transporting the substrate from the capillary slot to a spinning station to undergo spinning.

Advantageously, the method further comprises the step of positioning the substrate with the coated surface facing downwardly during spinning.

The method preferably further comprises the step of transporting the substrate with a linear transport device between the capillary slot and the spinning station that are positioned adjacent to one another.

Expediently, the substrate is held with a holding device comprising a motor and a turntable driven by the motor, wherein the turntable comprises means for releasably attaching the substrate thereto. The holding device is preferably connected to the linear transport device.

Advantageously, the method further comprises the step of positioning a protective ring, having in cross-section a U-shaped profile with slanted legs, about the substrate during spinning for catching the coating medium that is being spun off.

The method further comprises the step of lowering the protective ring into a rest position below the substrate between spinning operations.

Advantageously, the method comprises the steps of automatically loading the substrate onto the holding device with a loading station and automatically removing the substrate from the holding device at the spinning station with an unloading station, thereby performing the method fully automatically.

The substrate to be coated with the inventive method is preferably a wafer for producing a semiconductor.

Expediently, the method includes the step of providing an open channel that is partially filled to a filling level with the liquid coating medium and arranging in the open channel two parallel plates and immersed in the liquid coating medium contained in the channel so that the two parallel plates define the capillary slot.

The filling level is, for example, maintained by hydrostatic pressure from a compensation tank and refilling the compensation tank from a supply container.

After each step of coating the distance between the parallel plates is enlarged to cancel the capillary effect and preserve the liquid coating medium.

Immediately before each step of coating, the distance between the parallel plates is decreased for pressing a small amount of the liquid coating medium out of the capillary slot to thereby start the step of coating.

In an alternative embodiment, the substrate is preferably supported on a holding device and the capillary slot is moved relative to the holding device so that the step of coating is performed with the holding device being stationary and the capillary slot being moved across the substrate.

Expediently, the slot between the plates is narrowed directly before starting the lacquering process to reach the capillary width. Accordingly, the lacquer located between the plates is in a first step pressed mechanically upwardly until it exits from the upper end of the capillary slot and contacts the substrate surface arranged above the capillary slot. Thus, the coating process is started and is commenced due to the capillary effect within the slot that is now of a capillary width, the movement of the substrate, and adhesion, as described above.

DESCRIPTION OF PREFERRED EMBODIMENTS

The present invention will now be described in detail with the aid of several specific embodiments utilizing FIGS. 1 through 9.

FIG. 1 shows a first embodiment of a coating device 10 to be used in the present invention. A channel 12 as well as supports 13 and 14 for a linear transport device 15 are connected to a frame 11. The movable portion of the linear transport device 15 is facing downwardly. To it a rotatable holding device 16 for a substrate 17 to be coated is connected. The substrate is, for example, a glass plate 17 to be coated with lacquer for use in the subsequent manufacture of a mask or an LCD monitor. The plate 17, for example, is attached to the holding device 16 by a vacuum suction effect. For this purpose, the holding device 16 is provided with non-represented vacuum bores. Within the context of the invention it is also possible to use other holding devices that are known to a person skilled in the art.

Figure 2:
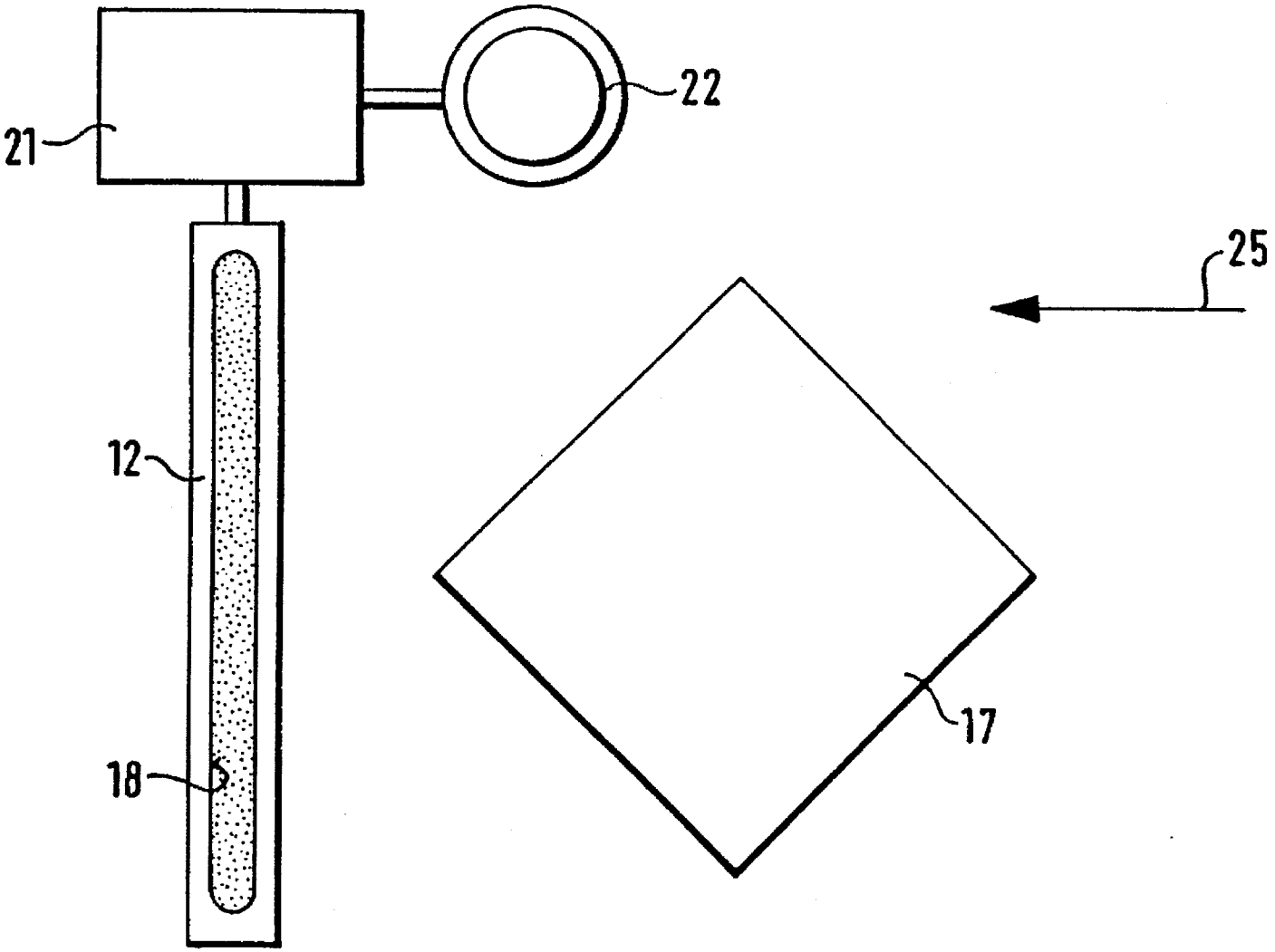
FIG. 2 shows a plan view of the channel of a lacquering and coating device according to FIG. 1 with compensation tank and supply container and a square plate to be coated.
Figure 4:
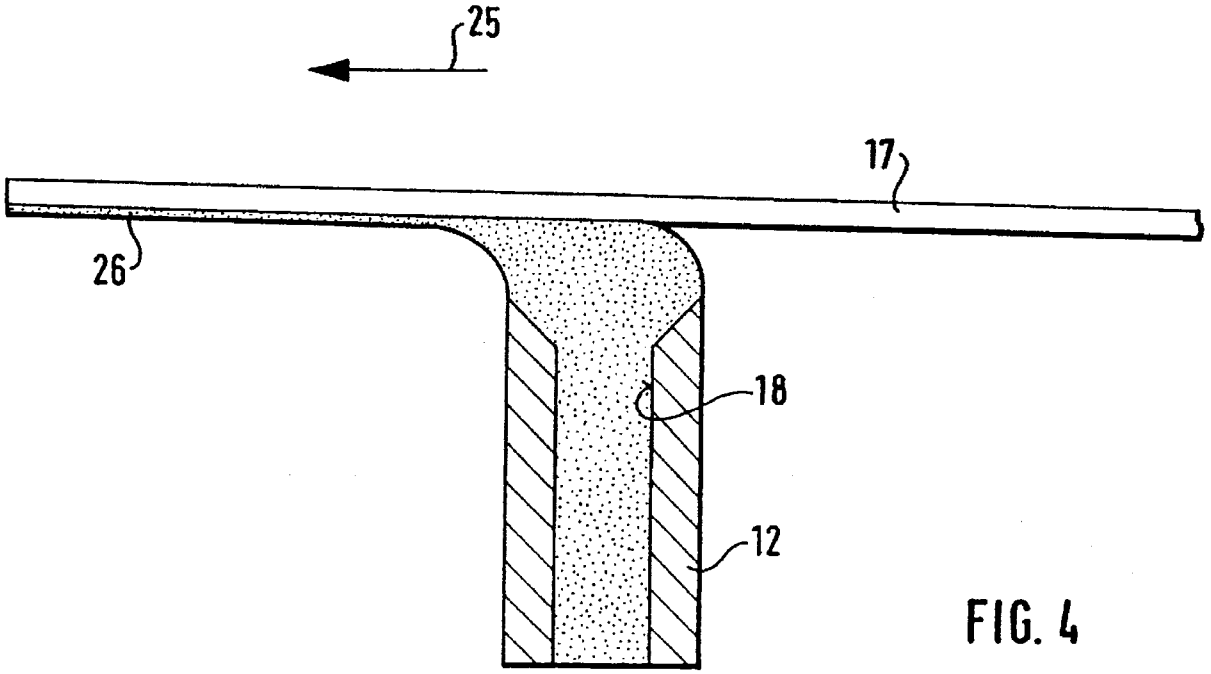
FIG. 4 shows a cross-section of the channel according to FIG. 3 with the plate during the lacquering, respectively, coating process.
Figure 3:
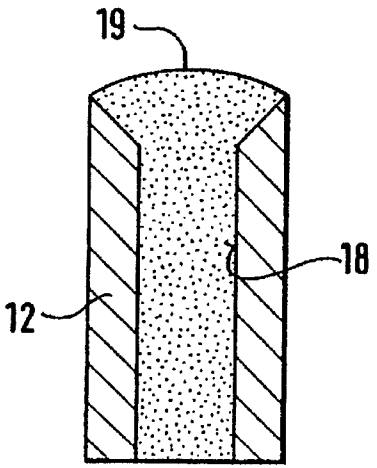
FIG. 3 shows a cross-section of the channel of a lacquering and coating device according to FIG. 1 with the convexly curved portion of the liquid shown.

The channel 12 is shown in a side view in FIG. 1, in a plan view in FIG. 2, and enlarged in a cross-sectional view in FIGS. 3 and 4. The cavity 18 of the open channel 12 is filled with lacquer to such an extent that at the upper side of the channel a convexly curved portion 19 projects outwardly from the channel. Accordingly, the plate 17 attached to the holding device 16 of the transport device 15 can be guided laterally to the convexly curved portion 19 without the risk of the plate surface contacting the upper edge of the open channel 12. This could result in damage to the plate surface and would cancel the result of the coating process.

The supports 13 and 14 of the linear transport device 15 are designed such that they can be adjusted to different heights. This property of the supports is not represented in the drawings. The adjustment of the height can be achieved with various mechanisms that are known to a person skilled in the art. This height adjustment of the supports 13 and 14 allows for the linear transport device 15 to be adjustable within certain limits to a desired angle 20 relative to the horizontal. Accordingly, the plate 17 can also contact the convexly curved portion 19 at an angle 20 of e.g. 2.5°. This is very advantageous for the coating result, as has been explained supra.

The open channel 12 is directly connected to a compensation tank 21 (FIG. 2). The filling level of the compensating tank is adjusted before the beginning of the coating process such that in the open channel 12 a pressure is achieved which generates the desired convexly curved portion 19. During the coating process, that is when lacquer is being used, the filling level of the compensation tank 21 is maintained at a constant level by a suitably controlled supply from a supply container 22. This is achievable, for example, by a float valve that is, for example, known from carburetors of vehicle engines. However, it is also possible to use other suitable control mechanisms that are known to a person skilled in the art.

For a fully automated version of the coating device, an automatic loading device is arranged at the location indicated at 23 end at the location indicated at 24 an automatic unloading device is mounted. The loading device removes the plate 17 to be coated from a magazine which is provided at a certain location and guides it to the plate holding device 16. The unloading device receives the plate 17 from the holding device 16 and transports it to a magazine provided at a certain location, or, in e preferred embodiment, to a spinning station, explained infra, for removing excess coating lacquer by centrifugal forces.

Operation of the First Embodiment of the Lacquering and Coating Device

In a first step, a plate 17 is automatically or manually connected to the holding device 16 in a relative position to the channel 12 represented in FIG. 2. By rotating the holding device 16 this position can be corrected. The holding device, at this point, is in the vicinity of the location that is indicated at 23 in FIG. 4. When the plate 17 is correctly positioned at the holding device 16, the linear transport device 15 is moved in the direction of arrow 25, that is, in direction toward the open channel 12.

The coating of the plate 17 begins as soon as its most forward point contacts the convexly curved portion 19. Subsequently, the connection of plate and lacquer as represented in FIG. 4 is achieved. The plate 17 moving in the direction of arrow 25 deforms the convexly curved portion in its direction of movement until a force equilibrium between liquid adhesion at the plate 17 and liquid cohesion within the channel 12 is generated. Subsequently, a thin liquid layer 26 (FIG. 4) is continuously deposited on the plate while the removed mass flow of liquid is replaced within the channel 12.

The coating process is terminated as soon as the connection between the plate 17 and the liquid flow from the channel 12 is interrupted at the rearmost point of the plate 17. The plate 17 is then moved into the area indicated at 24 in FIG. 1 where it is automatically or manually removed from the holding device 16. The holding device, as will be explained infra, can also be used as a means for spinning the plate to remove excess lacquering material by centrifugal forces.

Figure 5:
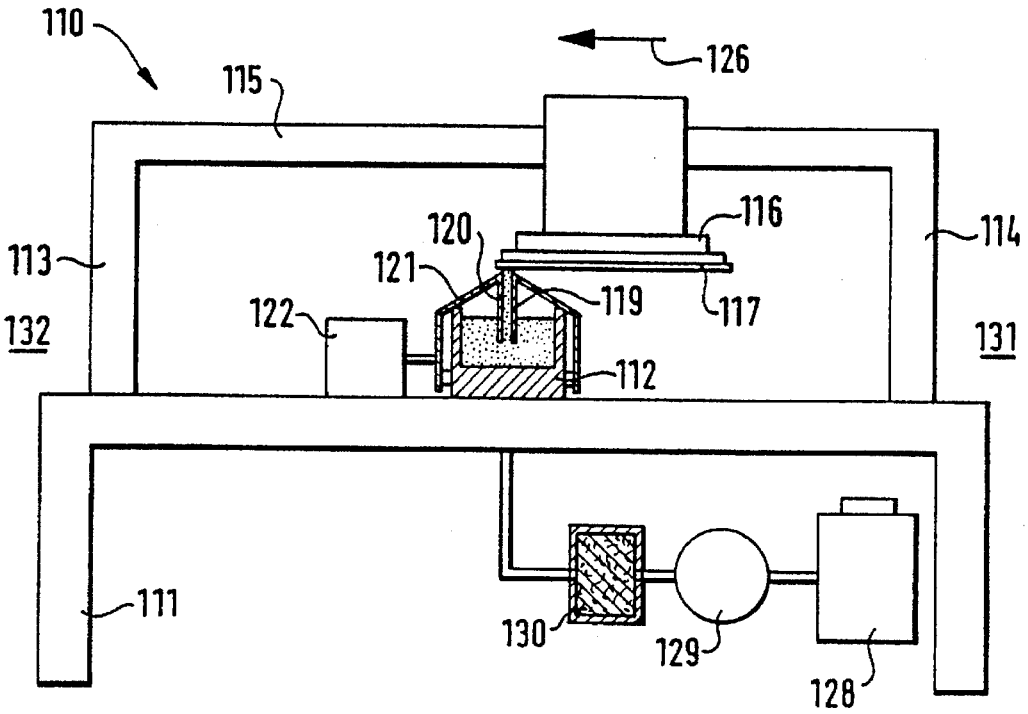
FIG. 5 shows a side view of e second lacquering and coating device according to the invention.

FIG. 5 shows a second embodiment of the inventive coating device 110. To a frame 111, a channel 112 as well as supports 113 and 114 of a linear transport device 115 are connected. The movable portion of the linear transport device 115 faces downwardly. Connected to it is a rotatable holding device 116 for the plate (substrate) 117 to be coated. The plate 117 is, for example, a glass plate to be coated with a lacquer in order to be used subsequently for the production of a mask or an LCD monitor. The plate 117 is, for example, supported by vacuum at the plate holding device 116. For this purpose, the holder 116 is provided with respective vacuum bores, that are not represented in the drawing. Within the context of the invention it is conceivable to use other holding devices whose design and construction are known to a person skilled in the art.

Figure 6:
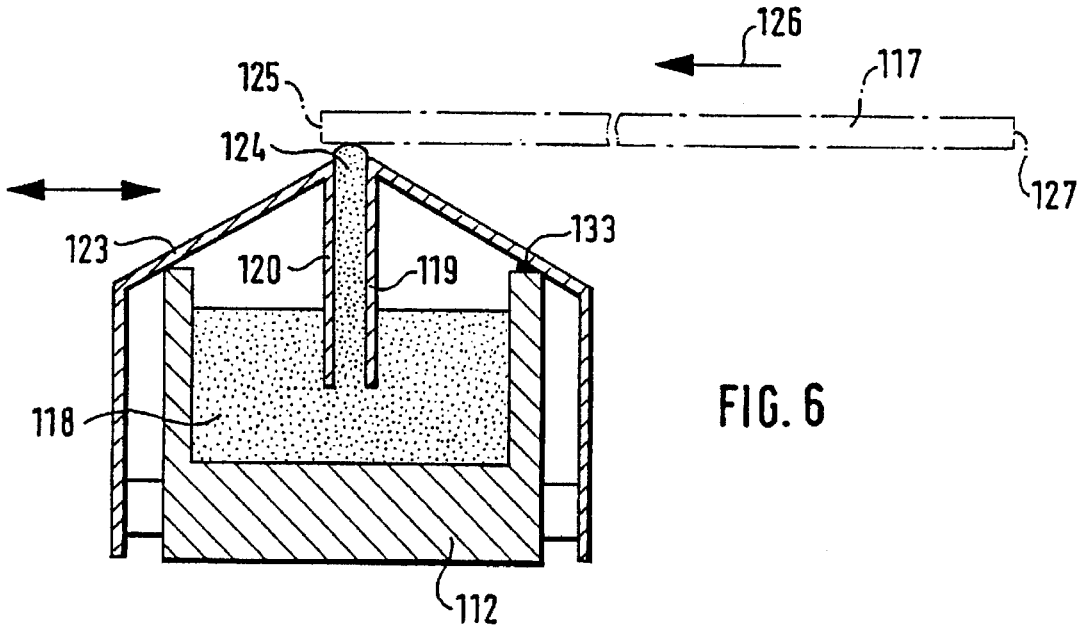
FIG. 6 shows a cross-section of the channel with capillary slot according to FIG. 5 at the beginning of a coating operation.

The channel 112 is represented in cross-section in FIG. 5 and, in greater detail, in FIG. 6. The hollow interior (cavity) 118 of the open channel 112 is partially filled with lacquer. Two thin parallel plates 119 and 120 are immersed in this lacquer. The plate 119 is fixedly connected at the location 133 to the upper edge of the channel 112. It is not displaceable. On the other hand, the plate 120 is connected to a linear displacement unit 122 by means of a suitable device. Via this displacement unit 122, the plate 120 can be moved back and forth in the direction of the arrow 123. Accordingly, the width of the slot 124 between the parallel plates 119 and 120 can be adjusted in an infinitely variable manner, especially to a spacing between the plates that results in a slot with capillary action that is less than 0.5 mm wide.

For achieving optimal lacquering or coating results, the corresponding liquid coating medium (lacquer) must have a certain temperature and must be very clean. Accordingly, it is supplied from a supply tank 128 via a temperature control unit 129 and a filter 130 to the channel 112. The conveying of the liquid medium can be achieved by generating a pressure (gas cushion) within the supply tank or by providing a suitable arrangement of the supply tank so that the liquid is conveyed by the geodetical height difference to the channel 112. However, any other suitable device, known to a person skilled in the art, for transporting the liquid is conceivable. It is also possible to use the arrangement of the supplying means as described in context with the first embodiment of FIGS. 1–4.

For a fully automated version of the coating device, at the location indicated at 131 an automated loading device and at the location 132 an automated unloading device are provided. The loading device (at 131) removes the plate 117 to be coated from a magazine connected to the frame and conveys the plate to the plate holder 116. The unloading device (132) removes the plate 117 from the holding device 116 and loads it into another magazine connected to the frame, or, in a preferred embodiment, the plate is transported to a spinning station for removing excess coating lacquer by centrifugal forces.

Mode of Operation of the Second Embodiment of the Lacquering and Coating Device

In a first step, the substrate (plate) 117 is automatically or manually connected to the holding device 116. By rotating the turntable of the holding device 116 the position of the substrate can be corrected. The holding device 116, at this time, is located at the location indicated at 131 in FIG. 5. After the plate has been correctly positioned at the holding device 116, the linear transport device 115 is set in motion in the direction of arrow 126, i.e., in direction toward the open channel 112.

Plate 117 is thus advanced from one side to the upper edge of the slot 124. As soon as the leading edge 125 of the plate 117 is positioned directly above the slot 124, the plate 120 within the channel 112 is advanced toward the plate 119 such that a suitable capillary width is provided between the plates, i.e., the slot becomes a capillary slot 124. Due to the narrowing of the capillary slot 124 a small amount of liquid is forced out of the capillary slot 124 against the leading edge of the plate 117 to be coated. Thus the coating process has begun. The plate 117 is now advanced further at a uniform and low velocity via the linear transport device 115 in the direction of arrow 126. Its distance from the capillary gap typically is less than 0.2 mm. Due adhesion, a thin liquid layer is deposited on the plate surface and is carried away from the upper end of the capillary slot with the substrate. The result is that the following lacquer, in addition to its upward movement by the capillary effect, is pulled from the capillary slot and, as a function of the velocity of the substrate, is deposited in a defined layer thickness on the substrate. Due to adhesion of the lacquer at the substrate surface there is also no risk that the lacquer, after exiting from the capillary slot, could flow laterally which would result in a decrease of the uniformness of the coating.

The required stream of liquid is supplied by the capillary effect within the capillary slot 124.

The coating process is terminated as soon as the rear edge 127 of the plate 117 passes the capillary slot 124. The two plates 119 and 120 are now moved apart to a distance of 2 to 3 mm for the aforementioned reasons until the next coating process is to be performed. This prevents the automatic (capillary) upward movement of the lacquer, which is undesirable between lacquering processes. It has been shown that during longer residence within the capillary slot the lacquer changes its properties. Such changes are disadvantageous for the lacquering process. However, when the capillary slot is widened to between 2 mm and 3 mm, the lacquer remains unchanged. The plate 117 is advanced to the location indicated at 132 where it may be automatically or manually removed from the holding device 116 and/or may be transported further to a spinning station where the substrate is spun to make the coating more uniform. According to this alternative embodiment of the present invention, it is no longer necessary to guide the substrates with a leading corner and at a small upward angle to the horizontal across the lacquering channel. Furthermore, it is no longer required that the liquid coating medium forms a meniscus above the channel (slot) so that supplying the lacquer via a compensation tank becomes obsolete.

Figure 7:
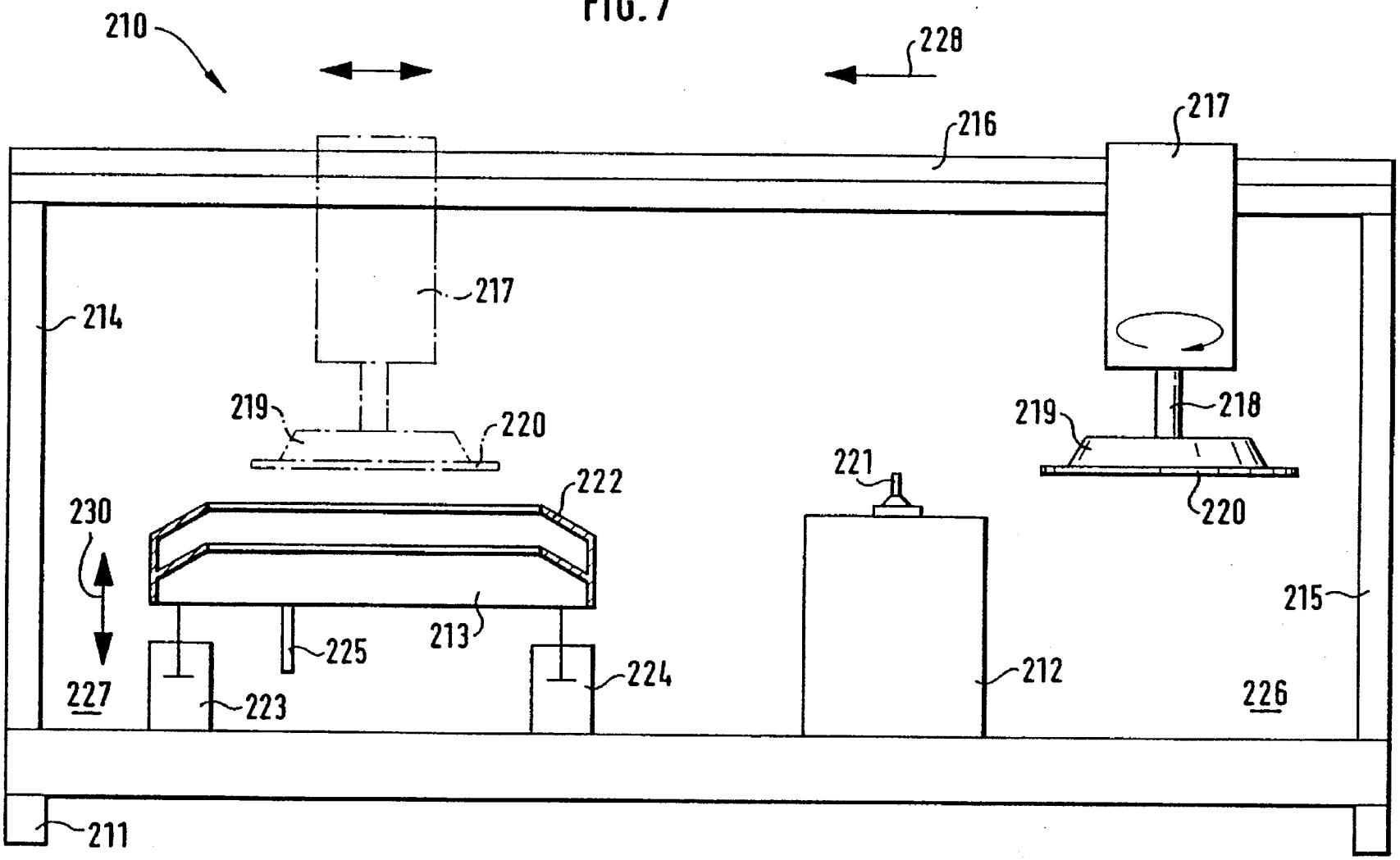
FIG. 7 is a side view of the design of an inventive lacquering and coating device.
Figure 9:
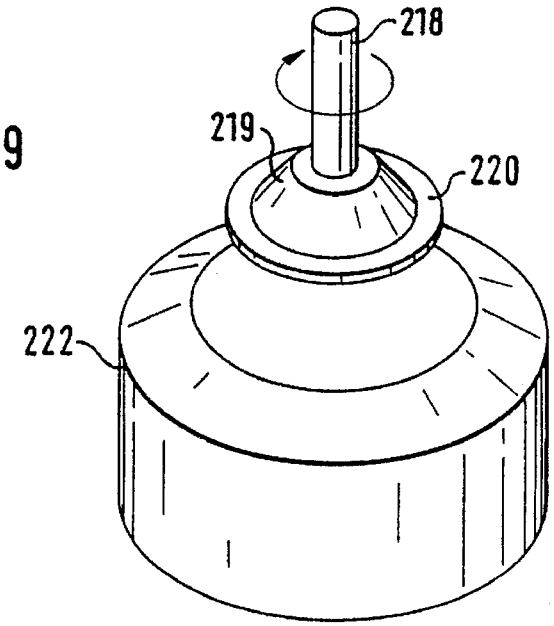
FIG. 9 shows a schematic perspective view of the spinning device of the coating device according to FIG. 7.

FIG. 7 shows a third and most preferred embodiment of an inventive coating device 210 comprising a spinning station 213. On a frame 211, an open channel 212 for the coating step and a protective ring 222 of the means for spinning including the spinning station 213 as well as supports 214 and 215 for a linear transport device 216 are connected. Connected to the linear transport device 216 is a holding device movable along the linear transport device and comprised of a rotating motor 217 and a turntable 219. The motor 217 has a shaft 218 to which the turntable 219 is connected. The substrate 220 to be coated is connected to the turntable 219 of the holding device 219, for example, by vacuum (suction). For this purpose, the turntable 219 is provided with respective vacuum bores, not represented in the drawing. In the context of the present invention, other holding devices known to a person skilled in the art are conceivable.

Figure 8:
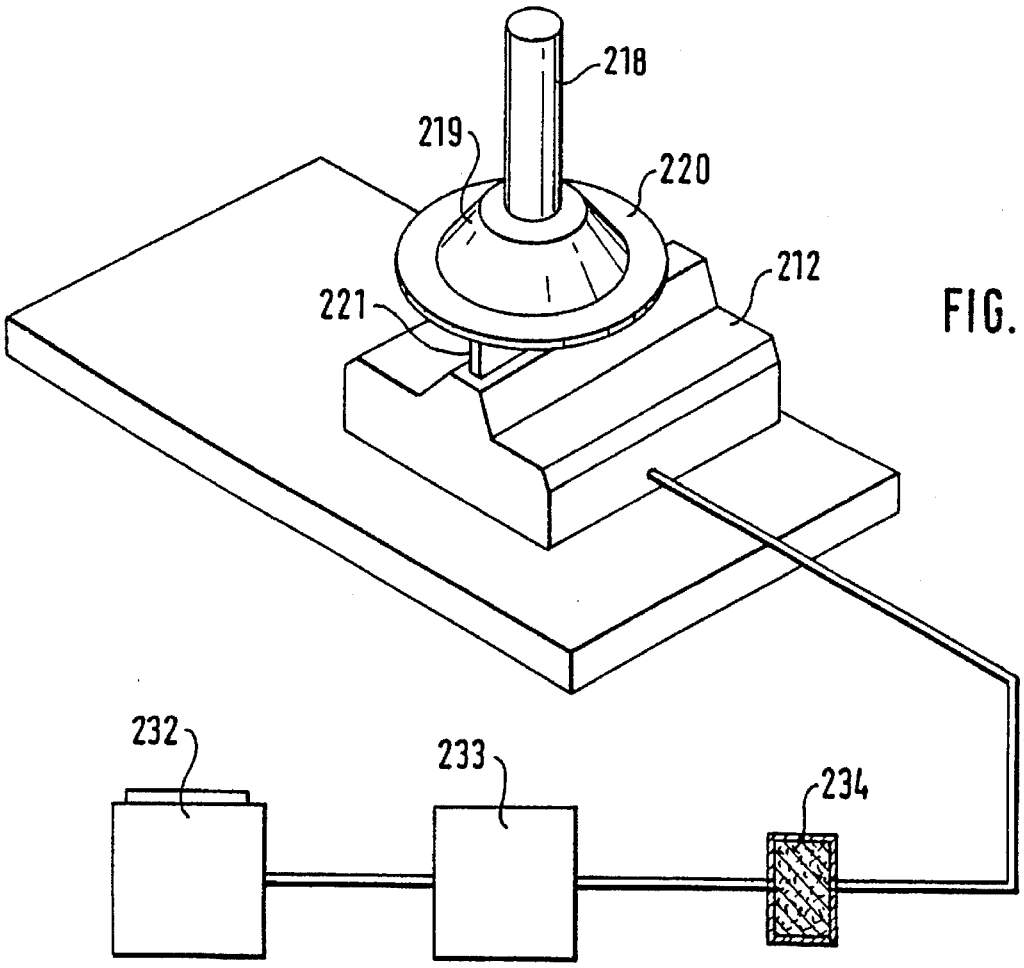
FIG. 8 is a schematic perspective view of the precoating device that is part of the coating device represented in FIG. 7.

The open channel 212 has a capillary slot 221 for the coating step of the method (shown schematically in FIG. 7 and further represented in FIG. 8 in a perspective, more detailed view). The design of the capillary slot 221 substantially corresponds to the design of the capillary slot 124 of the second embodiment explained in detail in connection with FIGS. 5 and 6. The open channel can be supplied with the coating medium by any of the aforedescribed supplying means. To this end, liquid is supplied from a supply tank 232 via a temperature control unit 233 and a filter 234 to the capillary gap 221, as shown in FIG. 8.

Adjacent to the capillary slot (coating station) a protective ring 222 of the spinning station 213 for the spinning process is arranged. The protective ring 222 is connected to one or more stands 223 and 224 which can automatically adjust the horizontal position of the protective ring 222. For example, this may be achieved by pneumatically adjustable units, but other devices known to a person skilled in the art are conceivable. For the spinning process the protective ring 222 is vertically upwardly displaced, for example, by means of the stands 223 and 224, until the protective ring 222 surrounds the substrate in a suitable manner. This is shown by arrows 230.

In FIG. 8 the substrate 220 to be coated is shown outside of the protective ring 222 and connected to the turntable 219 and the motor shaft 218. This position is represented in FIG. 7 in a dash-dotted line and illustrates the situation before or after the spinning process when the substrate 220 is connected to the linear transport device 216, respectively, the holding device 218, 219, in a position predetermined for the spinning process. However, the protective ring 222 in this position has not yet been displaced upwardly or has already been lowered. This upward and downward movement of the protective ring 222 is required in order to be able to move the substrate horizontally with the linear transport device 216 between coating and spinning stations.

FIG. 7 shows the protective ring 222 in cross-section. Its cross-section has a U-shaped profile with slanted legs. This design ensures that the lacquer or coating medium spun across the edge of the substrate is caught within the annular profile and is guided downwardly to the inner edge of the protective ring 222 from where it is removed completely from the inventive device by means of a lacquer removal device 225.

For a fully automated version of the coating device, automatic loading and unloading stations are provided in the areas indicated at 226, respectively, 227 in FIG. 7. The loading device removes the substrate 220 to be coated from a magazine connected to the coating device at an appropriate location and transfers it onto the holding device or turntable 219. The unloading device receives the substrate 220 from the turntable 219 at the spinning station after spinning and places it into a magazine provided at the device at a suitable location.

Mode of Operation of the Third Embodiment of the Lacquering and Coating Device

In a first step, a substrate 220 is automatically or manually connected to the turntable 219. The turntable 219 at this moment is in the area which is indicated by reference numeral 226 in FIG. 7. Subsequently, the linear transport device 216 with the holding device 218, 219 to which the substrate 220 is attached is moved in the direction of arrow 228, i.e., in a direction toward the channel 212.

As soon as the leading point or edge of the substrate 220 reaches the upper edge of the capillary slot 221, the coating step is started. Of course, the substrate 220 is moved across the capillary slot 221 of the channel 212 during coating.

After completion of the coating step, the substrate 220 is moved together with the turntable 219, the motor 217, and the drive shaft 218 in the direction of arrow 228 until it is centered above the protective ring 222 which at this moment is in its lowered rest position. When the substrate 220 has reached this position, the protective ring 222 is moved upwardly until the substrate 220 is surrounded by it in a suitable manner. Then the spinning process starts (the turntable is rotated) with which the lacquer layer thickness on the substrate 220 is made more uniform and thinner. The excess lacquer is spun off into the protective ring 222 and is removed via the lacquer removal device 225.

After completion of the spinning process, the protective ring 222 is lowered. The substrate 220 is subsequently transported by the transport device 216 into the area shown at 227 in FIG. 7 where it is automatically or manually removed from the turntable 219 of the holding device.

The present invention is, of course, in no way restricted to the specific disclosure of the specification and drawings, but also encompasses any modifications within the scope of the appended claims.

What we claim is:

1. A device for coating substrates in two steps, comprising:

an upwardly facing capillary slot for coating a downwardly facing surface to be coated of a substrate with a coating of a coating medium contained in said capillary slot; and a means for spinning the substrate so as to make the coating more uniform and thinner in a spinning operation by centrifugal forces acting on said coating;

said means for spinning comprising a spinning station positioned adjacent to said capillary slot; and a linear transport device adapted to transport the substrate from said capillary slot to said spinning station.

2. A device according to claim 1, wherein said linear transport device comprises a holding device for holding the substrate to be coated and moving the substrate across said capillary slot for coating.

3. A device according to claim 1, wherein said means for spinning comprises a holding device for holding the substrate, said holding device comprising a motor and a turntable driven by said motor, said turntable comprising means for releasably attaching the substrate thereto, said holding device being connected to said linear transport device and serving to transport the substrate.

4. A device according to claim 1, wherein said spinning station comprises a protective ring and means for positioning said protective ring around the substrate during spinning in order to catch the coating medium that is being spun off.

5. A device according to claim 4, wherein said means for positioning is adapted to lower said protective ring into a rest position below the substrate.

6. A device according to claim 3, further comprising a loading station for loading the substrate onto said holding device and an unloading station for removing the substrate from said holding device at said spinning station such that said device operates fully automatically.

7. A device according to claim 1, further comprising a means for supplying a liquid to said capillary slot.

8. A device for coating substrates in two steps, comprising:

an upwardly facing capillary slot for coating a downwardly facing surface to be coated of a substrate with a coating of a liquid coating medium contained in said capillary slot;

a means for spinning the substrate so as to make the coating more uniform and thinner in a spinning operation by centrifugal forces acting on said coating;

a means for supplying the liquid coating medium to said capillary slot;

wherein said means for supplying comprises an open channel to be partially filled to a filling level with the liquid coating medium and wherein said capillary slot is formed by two parallel plates immersed into the liquid coating medium filled into said channel, wherein the filling level is maintained constant by means of said means for supplying.

9. A device according to claim 8, wherein said means for supplying a liquid comprises a compensation tank and a supply container, wherein the filling level is maintained constant by hydrostatic pressure from said compensation tank and wherein said compensation tank is refilled by said supply container.

10. A device according to claim 8, further comprising means for adjusting a distance between said parallel plates in a variable manner.

11. A device according to claim 10, wherein after each coating process said distance between said parallel plates is enlarged to cancel the capillary effect for preserving the liquid coating medium.

12. A device according to claim 10, wherein immediately before each coating process said distance between said parallel plates is decreased for pressing a small amount of the liquid coating medium out of said capillary slot to thereby start the coating process.

13. A method for coating substrates, comprising the steps of:

coating a downwardly facing surface of a substrate by passing the substrate over an upper end of a capillary slot containing a coating medium to produce a coated substrate with a coating on the downwardly facing surface thereof;

transporting the substrate by means of a linear transport device from said capillary slot to a spinning station; and spinning the coated substrate so as to make the coating more uniform by centrifugal forces acting thereon during spinning.

14. A method according to claim 13, wherein the step of transporting is performed automatically.

15. A method according to claim 13, further comprising the step of positioning the substrate with the coated surface facing downwardly during spinning.

16. A method according to claim 13, further comprising the step of holding the substrate with a holding device comprising a motor and a turntable driven by said motor, said turntable comprising means for releasably attaching the substrate thereto, said holding device being connected to said linear transporting device.

17. A method according to claim 16, further comprising the steps of automatically loading the substrate onto said holding device at a loading station and automatically removing the substrate from said holding device at said spinning station at an unloading station.

18. A method according to claim 13, further comprising the steps of positioning a protective ring about the substrate during spinning and catching the coating medium that is being spun by means of said protective ring.

19. A method according to claim 16, further comprising the step of lowering said protective ring into a rest position below the substrate between spinning operations.

20. A method according to claim 13, wherein the substrate is a wafer for producing a semiconductor.

21. A method according to claim 13, further comprising the steps of:

supporting the substrate on a holding device; and moving said capillary slot relative to said holding device so that the step of coating is performed with said holding device being stationary and said capillary slot being moved across the substrate.

22. A method for coating substrates, comprising the steps of:

providing a channel and partially filling to a filling level said channel with the liquid coating medium;

arranging in said channel two parallel plates and immersing said two parallel plates in the liquid coating medium contained in said channel so that said two parallel plates define a capillary slot;

coating a downwardly facing surface of a substrate by passing the substrate over an upper end of said capillary slot containing the coating medium to produce a coated substrate with a coating on the downwardly facing surface thereof;

spinning the coated substrate so as to make the coating more uniform by centrifugal forces acting thereon during spinning.

23. A method according to claim 22, further comprising the steps of:

maintaining the filling level constant by hydrostatic pressure from a compensation tank; and refilling the compensation tank from a supply container.

24. A method according to claim 22, further comprising the step of:

enlarging a distance between said parallel plates after each coating step to cancel the capillary effect and to preserve the liquid coating medium.

25. A method according to claim 22, further comprising the step of:

decreasing a distance between said parallel plates before each coating step for pressing a small amount of the liquid coating medium out of said capillary slot to thereby start the coating step.

* * * * *